US008695977B2

(12) United States Patent
Nunn et al.

(10) Patent No.: US 8,695,977 B2
(45) Date of Patent: Apr. 15, 2014

(54) APPARATUS AND METHOD FOR TRIPLE-GATE DIVERTER

(71) Applicant: MEI, Inc., Malvern, PA (US)

(72) Inventors: Michael D. Nunn, West Chester, PA (US); Karen Marvin, Pottstown, PA (US)

(73) Assignee: MEI, Inc., Malvern, PA (US)

( * ) Notice: Subject to any disclaimer, the term of this patent is extended or adjusted under 35 U.S.C. 154(b) by 0 days.

(21) Appl. No.: 13/737,443

(22) Filed: Jan. 9, 2013

(65) Prior Publication Data

US 2013/0181397 A1 Jul. 18, 2013

Related U.S. Application Data

(60) Provisional application No. 61/586,101, filed on Jan. 12, 2012.

(51) Int. Cl.
*B65H 39/10* (2006.01)

(52) U.S. Cl.
USPC ..... 271/303

(58) Field of Classification Search
USPC ..... 271/301–305, 225, 184, 185, 296, 297
See application file for complete search history.

(56) References Cited

U.S. PATENT DOCUMENTS

| | | | | |
|---|---|---|---|---|
| 3,310,304 | A * | 3/1967 | Foias et al. | 101/234 |
| 4,486,015 | A * | 12/1984 | Takahashi | 271/305 |
| 5,228,681 | A * | 7/1993 | Arnold | 271/303 |
| 2003/0234487 | A1 * | 12/2003 | Tamura et al. | 271/303 |

* cited by examiner

*Primary Examiner* — Thomas Morrison
(74) *Attorney, Agent, or Firm* — Mintz Levin Cohn Ferris Glovsky and Popeo, P.C.

(57) ABSTRACT

Apparatus and methods for handling items of currency using a triple gate diverter are provided. An apparatus is provided that comprises first, second and third diverter members (100, 200, 300) that are adapted for rotational/pivotal movement with respect to another. Each of the diverter members (100, 200, 300) is coupled to a longitudinal shaft (400), itself defining a central longitudinal axis of the triple gate diverter.

13 Claims, 12 Drawing Sheets

APPARATUS AND METHOD FOR TRIPLE-GATE DIVERTER

RELATED APPLICATIONS

This application claims priority to U.S. Provisional Application No. 61/586,101, filed on Jan. 12, 2012, the content of which is hereby expressly incorporated by reference.

FIELD OF DISCLOSURE

This disclosure relates to apparatus and methods of handling items of currency. More particularly, this disclosure relates to apparatus for and methods of using a triple-gate diverter to handle items of currency.

BACKGROUND

For the purposes of the disclosure, the terms bill, currency and/or item of currency includes, but is not limited to, valuable papers, security documents, banknotes, checks, bills, certificates, credit cards, debit cards, money cards, gift cards, coupons, coins, tokens, and identification papers.

Basic diverters are known in the art and have been described, for example, in patent application WO 2008/047094, U.S. Pat. Nos. 7,185,888, 7,904,015, 7,108,260, and 7,708,276. However, typical diverters have significant space requirements and the more pathways a diverter system supports, the greater the challenge to accommodate the diverter mechanism into the limited space available.

DETAILED DESCRIPTION

Figure 14:
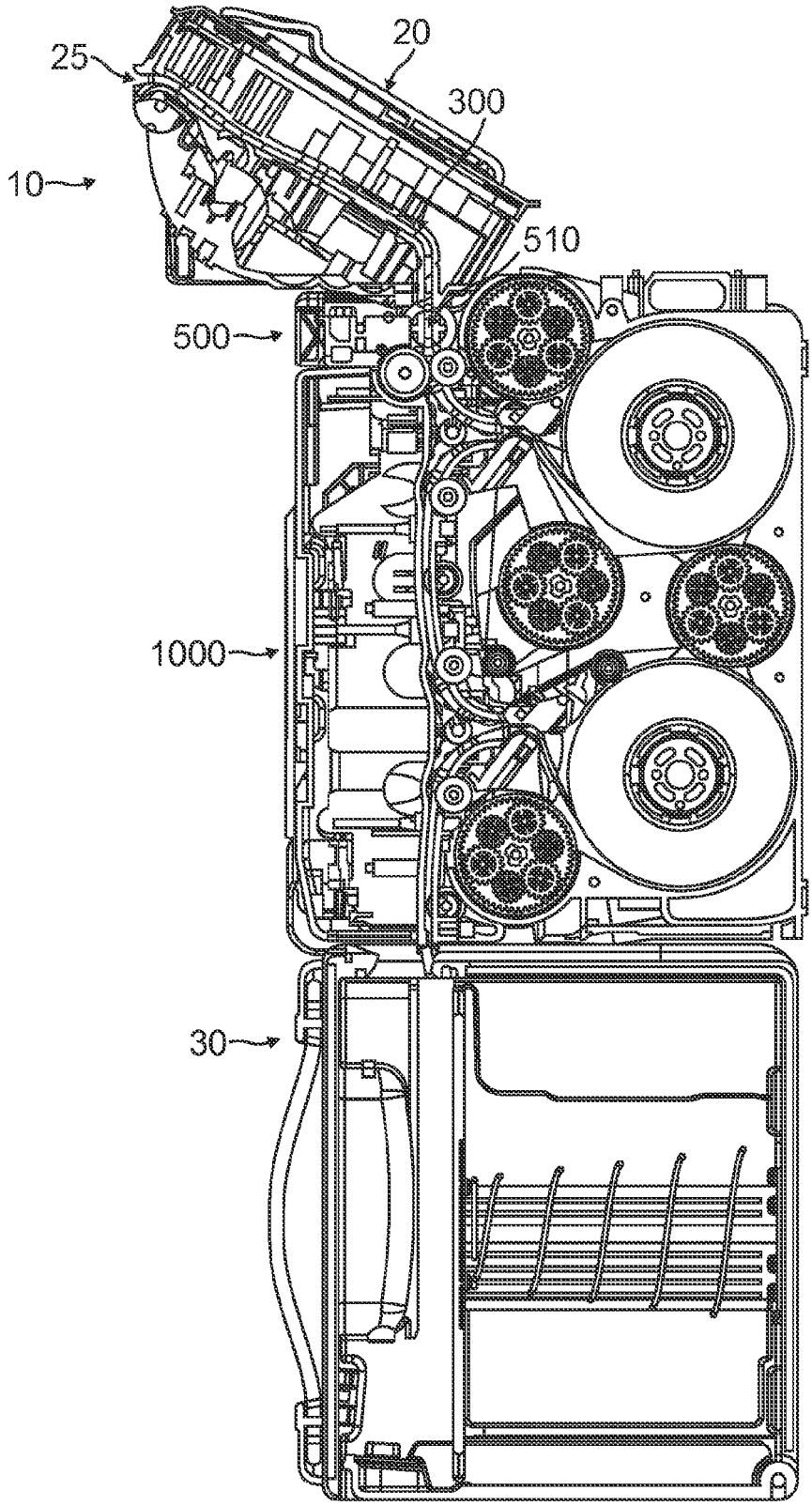
FIG. 14 is a schematic view of a currency handling apparatus.

A currency handling apparatus 10 (see FIG. 14) capable of receiving insert items of currency and storing at least some of the inserted items for later dispensing as change in a subsequent transaction. The currency handling apparatus includes a validation module 20, a currency recycling module 1000, and a currency storage module 30. The validator module 20 is capable of evaluating inserted items of currency for at least one of the type, validity, authenticity and condition, and denomination.

The validator module 20 can be capable of sensing characteristics of an inserted item of currency using electro-magnetic, optical, or magnetic properties and principles. The currency storage module 30 can be of the type configured to receive acceptable items of currency and store them in a secure container for later collection. An example currency storage module can be one of the type disclosed in U.S. Pat. No. 6,712,352 which is hereby expressly incorporated herein by reference in its entirety.

The recycling module 1000 is a two-way storage device capable of temporary storage of inserted items of currency. This module is capable of temporary storage of inserted currency items and capable of dispensing any storage items of currency. This module can be configured to store currency items on a single or plurality of rotary storage drums or store currency items in a stacked face-to-face relationship.

In the example illustrations, the currency handling apparatus includes multiple currency storage drums operatively coupled to a currency handling apparatus transport passageway. In the illustrated examples, the coupling of a two-way storage device to the transport passageway is configured such that multiple pathways exist between the validator module, the recycling module and the currency storage module. In some implementations, a diverter apparatus is included to facilitate high efficiency transport of inserted and stored currency between the various modules. Such a configuration allows for the shuffling of currency items between multiple rotary storage drums as well as between the storage drums and the currency storage module and/or the validator module.

In operation when a currency item is inserted into the storage module, the validation module evaluates the currency item for type and authenticity. In order for the validator module to determine the type and authenticity of the inserted currency, the inserted currency item may need to be temporarily stored (or escrowed) until the validator module can make a determination as its acceptability. In some implementations, the transport passageway between the validator module and the recycling module is short such that an escrow position is in a location after the validation module. In some implementations, the escrow position is located on one of the multiple recycling stores. In other implementations, the escrow position is located along the transport passageway between the various storage modules.

In the illustrated examples, the transport passageway includes a diverter apparatus to control the flow of currency items within the currency handling apparatus. The diverter apparatus is capable of selectively altering the transport passageway such that currency items can flow between the validator module and one of the recycling storage areas (e.g. a rotary storage drum), between multiple recycling storage areas, and between any one of the multiple recycling storage areas and the currency storage module. In some implementations, the diverter apparatus is configured to further alter the transport passageway such that currency items can be transported from at least one of the recycling storage areas to the validator module for dispensing through an inlet/outlet of the currency handling apparatus.

In the illustrated examples, the diverter apparatus is configured to provide a plurality of transport paths into and out of the recycling storage areas. The diverter apparatus can be configured to rotate (or slide) individual guiding portions either individually, or in concert with each other in order to provide a high efficiency movement of currency items within the currency handling apparatus.

A low-cost, robust, compact, and high-efficiency diverter apparatus and methods are disclosed herein. In one aspect, the diverter can be used in a money handling apparatus to divert an item of currency along a bill path. In another aspect, the diverter can comprise a plurality of diverter members that can be configured to rotate about a common longitudinal axis.

Figure 1:
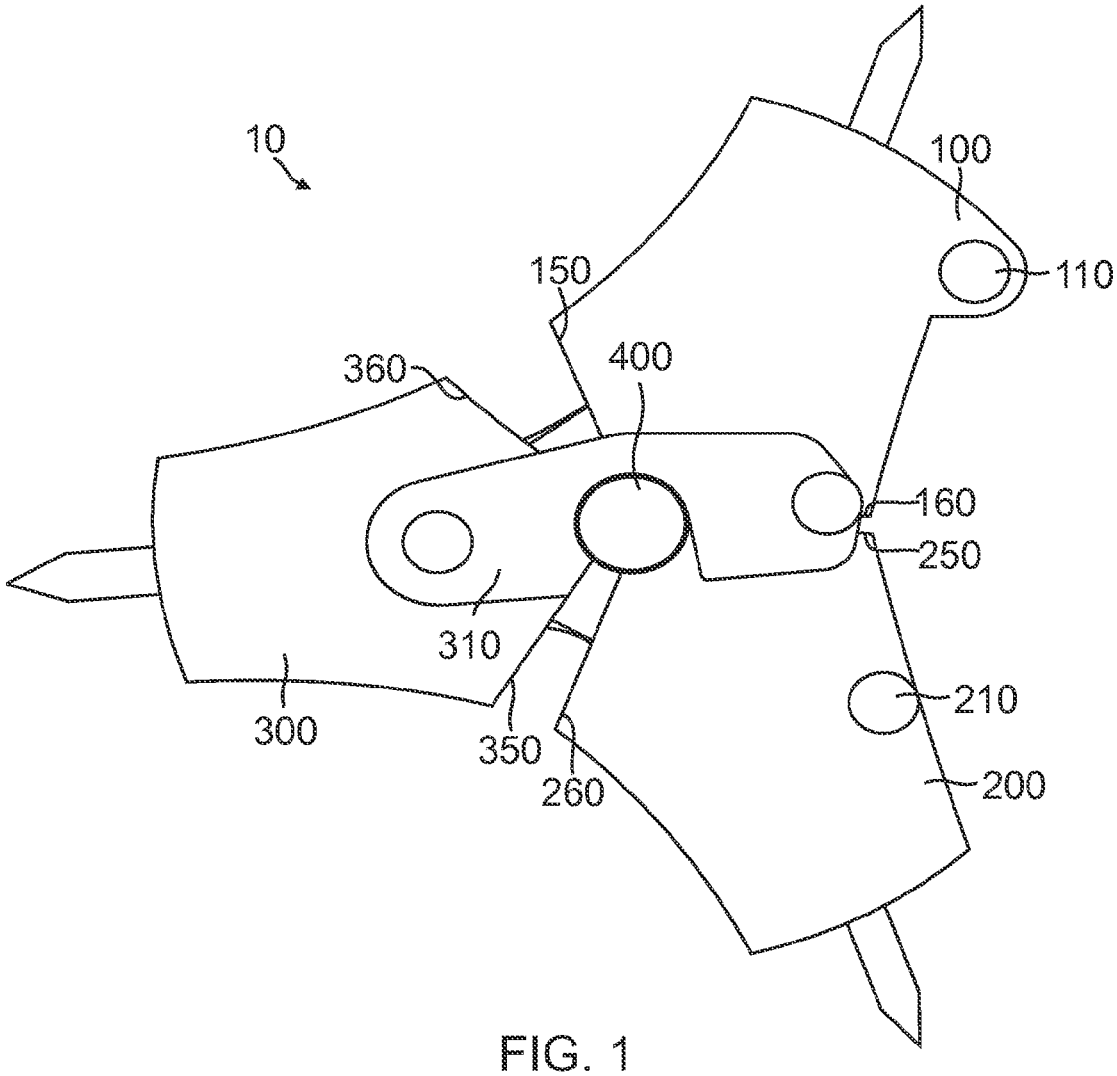
FIG. 1 is a schematic view of a triple-gate diverter in a first position according to an embodiment.

In one implementation, as shown in FIG. 1, a triple diverter comprises first, second, and third diverter members 100, 200, and 300 adapted for rotational/pivotal movement with respect to one another. Each of the diverter members 100, 200, and 300 is coupled to a longitudinal shaft 400, itself defining a central longitudinal axis.

Figure 2:
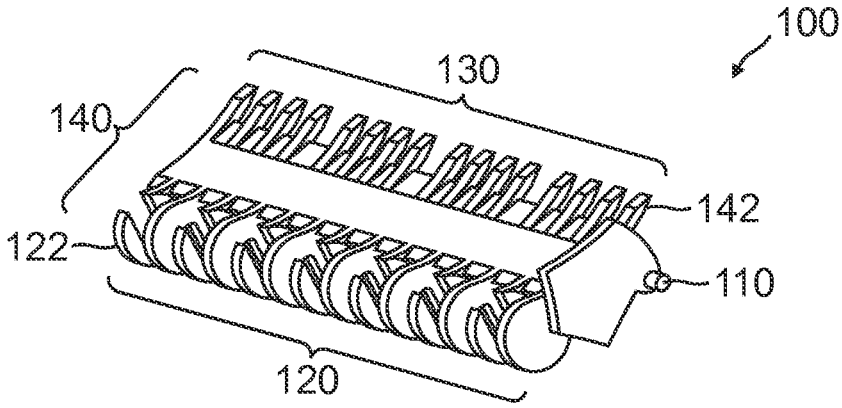
FIG. 2 is a schematic view of a diverter member according to an embodiment.
Figure 3:
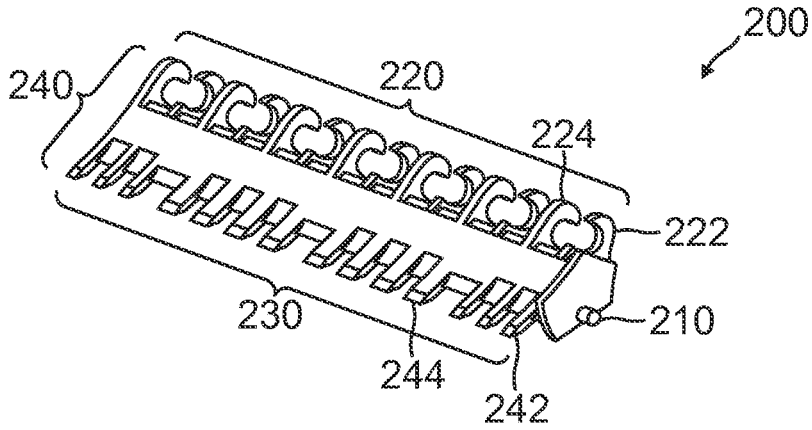
FIG. 3 is a schematic view of a diverter member according to an embodiment.
Figure 4:
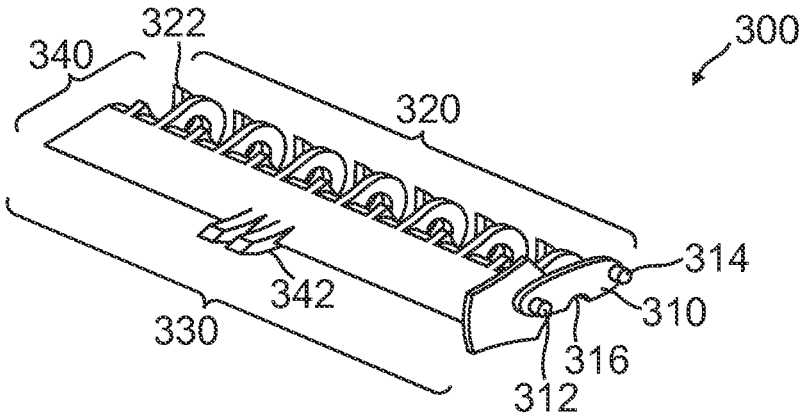
FIG. 4 is a schematic view of a diverter member according to an embodiment.
Figure 5:
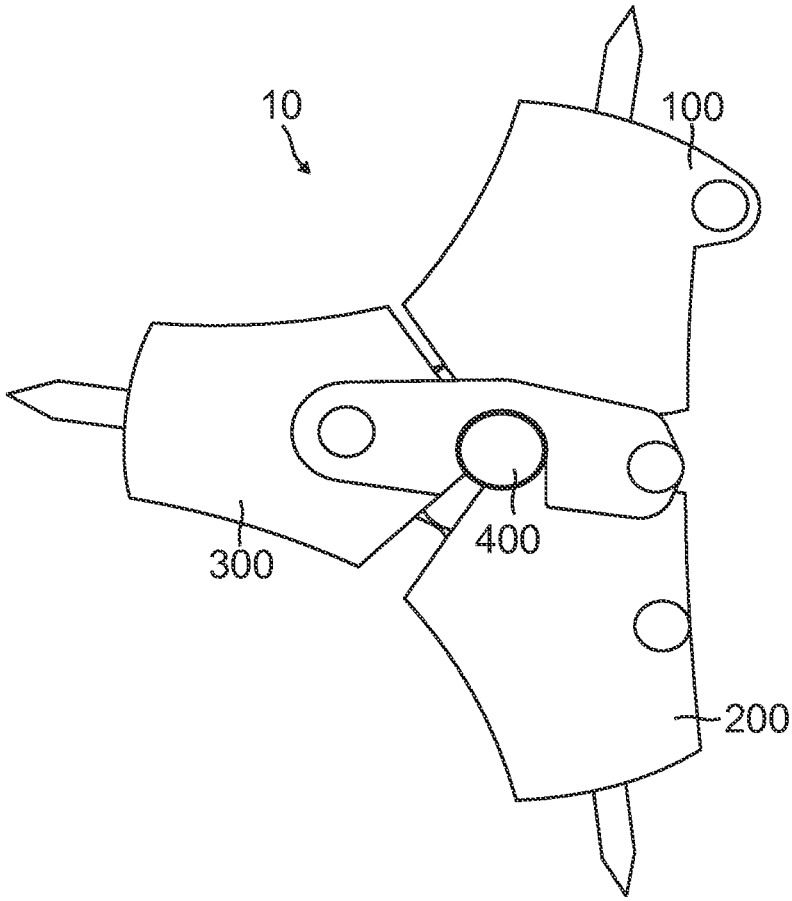
FIG. 5 is a schematic view of a triple-gate diverter in a first position according to an embodiment.
Figure 6:
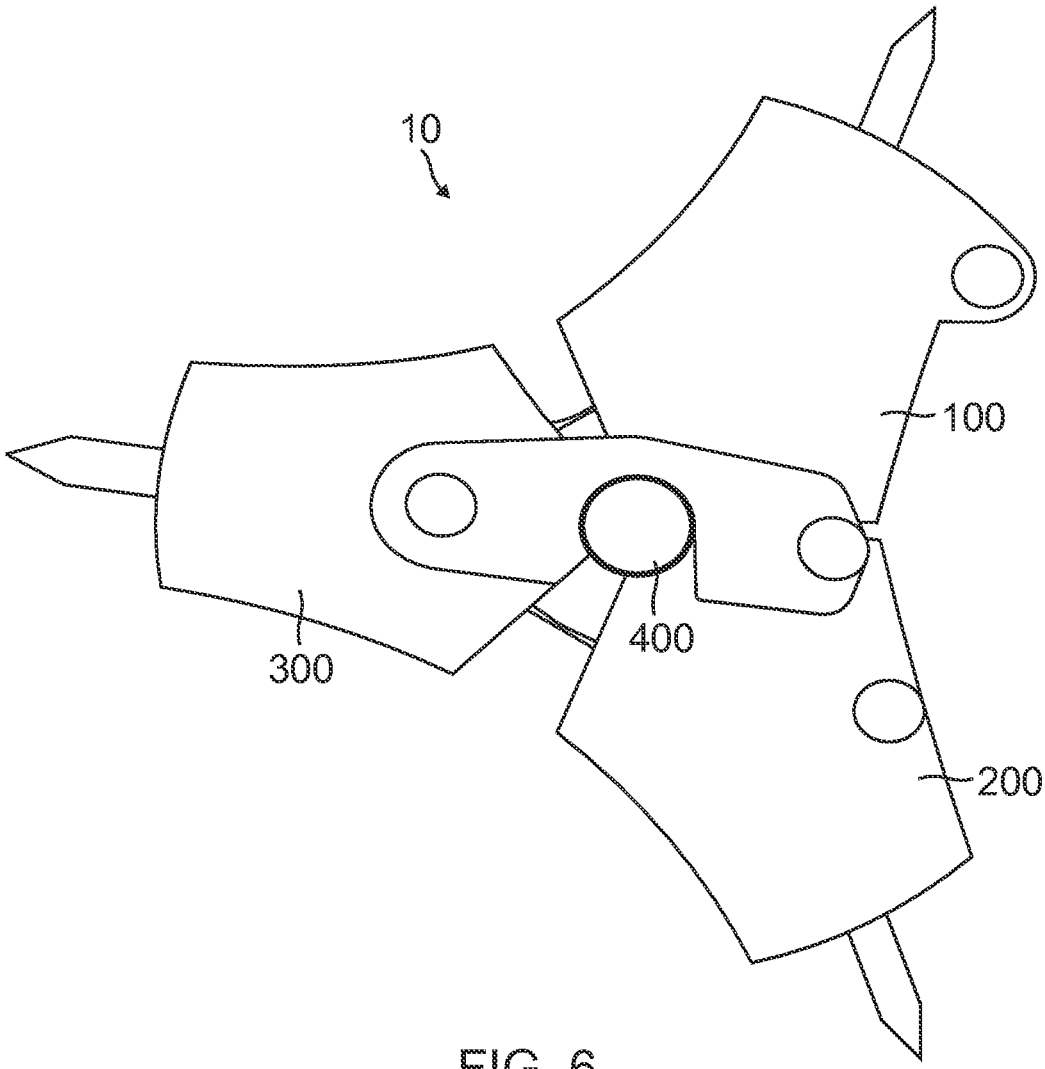
FIG. 6 is a schematic view of a triple-gate diverter in a second position according to an embodiment.
Figure 7:
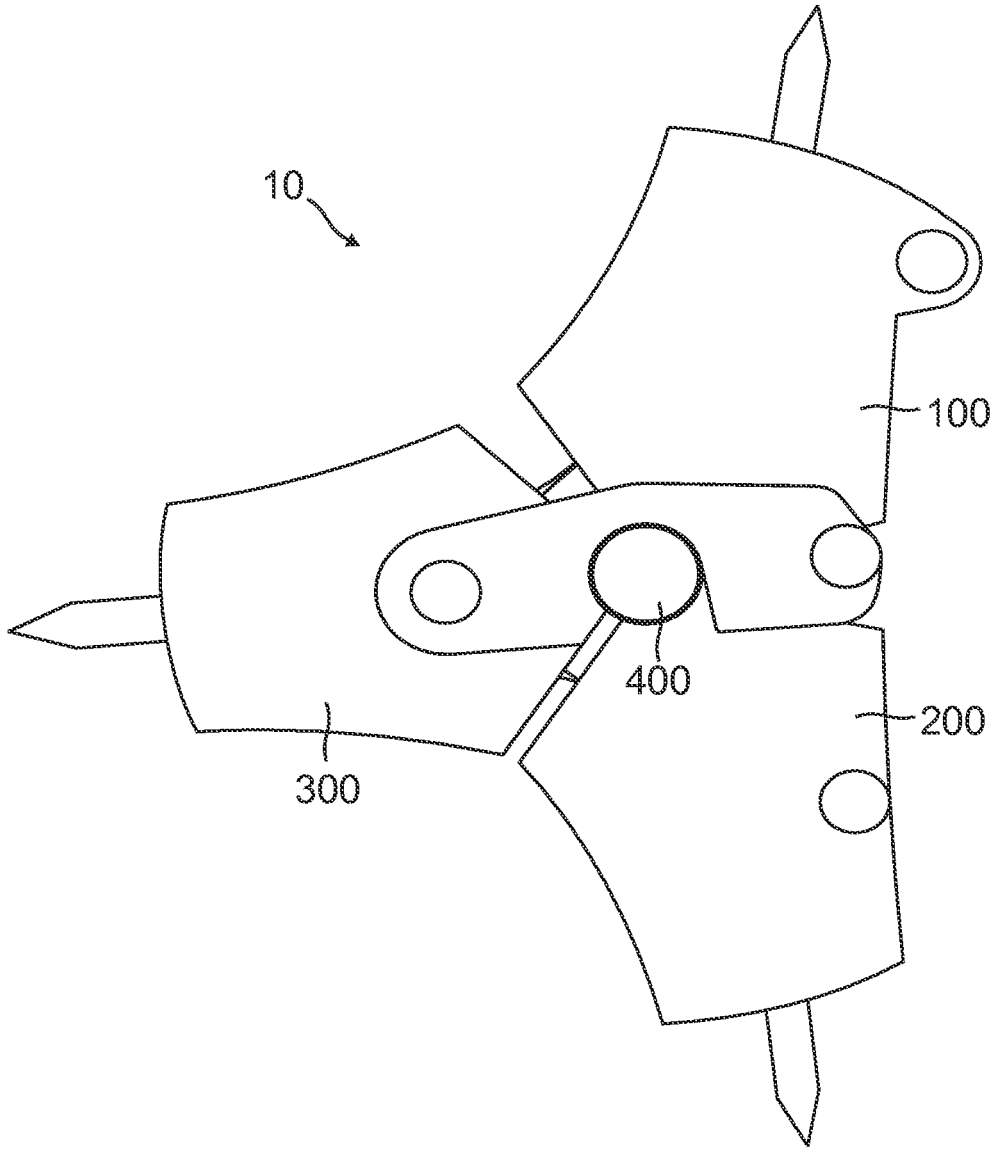
FIG. 7 is a schematic view of a triple-gate diverter in a third position according to an embodiment.

In one embodiment, as shown in FIGS. 2-4, each of the diverter members 100, 200, or 300 respectively comprise a outer longitudinal edge 130, 230, or 330, an inner longitudinal edge 120, 220, or 320, and a bill handling surface 140, 240, or 340. In this design, each of the bill-handling surfaces 140, 240, or 340 is disposed between the respective outer longitudinal edges 130, 230, or 330 and the respective inner longitudinal edges 120, 220, or 320. In some embodiments, each diverter member defines two bill handling surfaces which are essentially on opposite sides of the diverter member. As will be appreciated from further discussion below, a bill handling surface from each of two of the three diverter members provides a combined bill handling surface dependent upon the rotation of each member, and the desired path. In another aspect, each of the inner longitudinal edges 120, 220, or 320 are capable of being mounted to a shaft (not shown) for rotation about a longitudinal axis. The description herein refers to inner and outer longitudinal edges when addressing the triple diverter members generically. It should be understood that when addressing the individual diverter members, the same portions are the first inner longitudinal edge, the first outer edge, the second inner longitudinal edge, the second outer edge, the third inner longitudinal edge, and the third outer edge, respectively, where the ordinal first, second or third refers helps distinguish between the three diverter members. The diverter members 100, 200 and 300 can have one or more of the following characteristics:

| Part | Volume ($mm^3$) | Material | Density ($g/mm^3$) | Weight (N) | Pivot Radius (mm) | Degree of Rotation | Torque (mNm) |
|---|---|---|---|---|---|---|---|
| Diverter 100 | 4390 | 30% GF, PBT (Valox 420) | 0.00153 | 0.066 | 17.02 | 12° | 1.121 |
| Diverter 200 | 4496 | 30% GF, PBT (Valox 420) | 0.00153 | 0.067 | 12.65 | 12° | 0.853 |
| Diverter 300 | 4226 | 30% GF, PBT (Valox 420) | 0.00153 | 0.063 | 8.25 | 13° | 0.523 |

Figure 13:
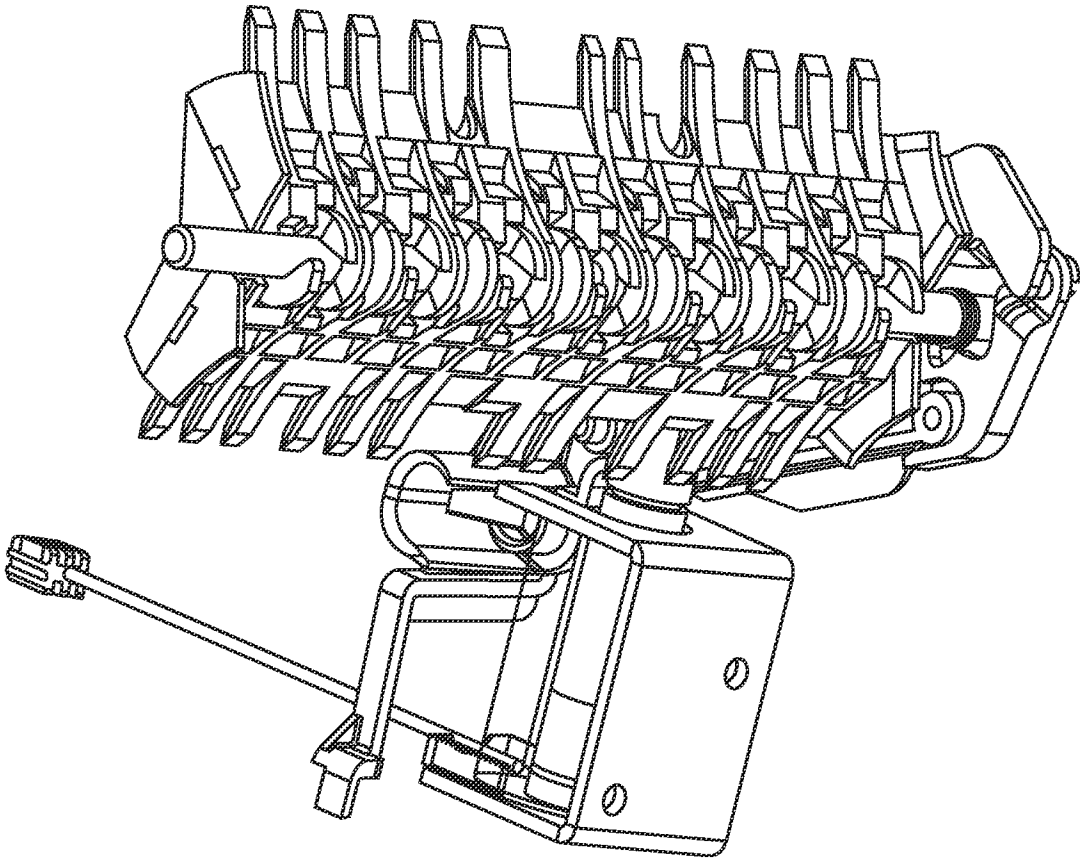
FIG. 13 is a schematic view of a triple-gate diverter with one diverter member removed.

Optionally, the first inner longitudinal edges 120, 220, or 320 can each comprise a plurality of bearing members 122, 222, or 322. In one design, each plurality of bearing members 122, 222, or 322 can be configured to be capable of interengaging with complimentary structures of other diverting members (not shown), or with each other. That is, the first inner longitudinal edge may interengage with either or both of the second inner longitudinal edge and the third inner longitudinal edge. As shown in a perspective view, e.g. FIG. 13, each inner longitudinal edge is adapted to be coupled to the central shaft and to be interleaved with the other inner longitudinal edges, forming a knuckle, which adds both strength and flexibility to the entire structure.

In some embodiments, each of the diverter members can be designed to be structurally equivalent, identical, similar, dissimilar, or complimentary. However, in other embodiments, as shown in FIG. 1, each of the diverter members can be structurally optimized to correspond to particular requirements, such as but not limited to bill-handling requirements, sequencing requirements, geometrical constraints, or any combination thereof.

For example, referring to FIGS. 2-4, each of the bill-handling surfaces 140, 240, and 340 are individually configured to provide a relatively smooth transition for a bill that is moving along each bill path.

In one aspect, the bill handling surfaces 140, 240, and 340 can each include a plurality of interleaving members 142, 242, and 342, which interleave with complimentary structures disposed along each respective bill path. In another aspect, each of the bill-handling surfaces 140, 240, and 340 can include different curvatures that are optimized to reduce interference with the movement of a bill along each individual bill paths.

In some designs, as shown in FIG. 3, a diverter member 200 can comprise a plurality of interleaving members 242 and 244 that vary in dimension. In one aspect, interleaving members 242 and 244 can be varied in width to optimize the bill-handling performance. However, it should be understood that the interleaving members 242 and 244 can be varied in any dimension, such as but not limited to, length, thickness, or any combination thereof. In another aspect, interleaving members 242 and 244 can be varied in geometry to optimize the bill-handling performance. For example, as illustrated, interleaving members 242 and 244 can be configured with a beveled surface. In another aspect, each of the interleaving members 242 and 244 can be configured a curvature that minimizes interference with a bill that is moving along a bill path.

In some embodiments, as shown in FIG. 1, each diverter member 100, 200, and 300 can each be configured to cooperate with an adjacent diverting member to limit a pivoting range of an intervening diverter member. For example, in the position shown in FIG. 1, diverter members 100 and 200 are shown to be cooperating with each other to limit the pivoting range of the diverting member 300 about the shaft 400 to the arc length defined between edge 150 and edge 260.

In the embodiment shown in FIG. 1, each of the diverter members 100, 200, and 300 has an approximately equal pivoting range about the shaft 400. However, it should be understood that each diverter member 100, 200, and 300 can have an unequal pivoting range without departing from the spirit and scope of the disclosure. For example, as shown in FIG. 2, bearing members 122 can be configured to cooperate with corresponding structures (not shown) on shaft (not shown) to individually limit the pivoting range of the diverter member 100.

In one aspect, the pivoting of each diverter member 100, 200, and 300 shown in FIG. 1, can be independently controlled. For example, each of the diverter members 100, 200, and 300, can be coupled to independent actuators (not shown). In one aspect, the diverter members 100, 200, and 300 can include linkage structures 110, 210, and 310 that are configured to mechanically couple directly or indirectly with the respective actuator (not shown).

Figure 12:
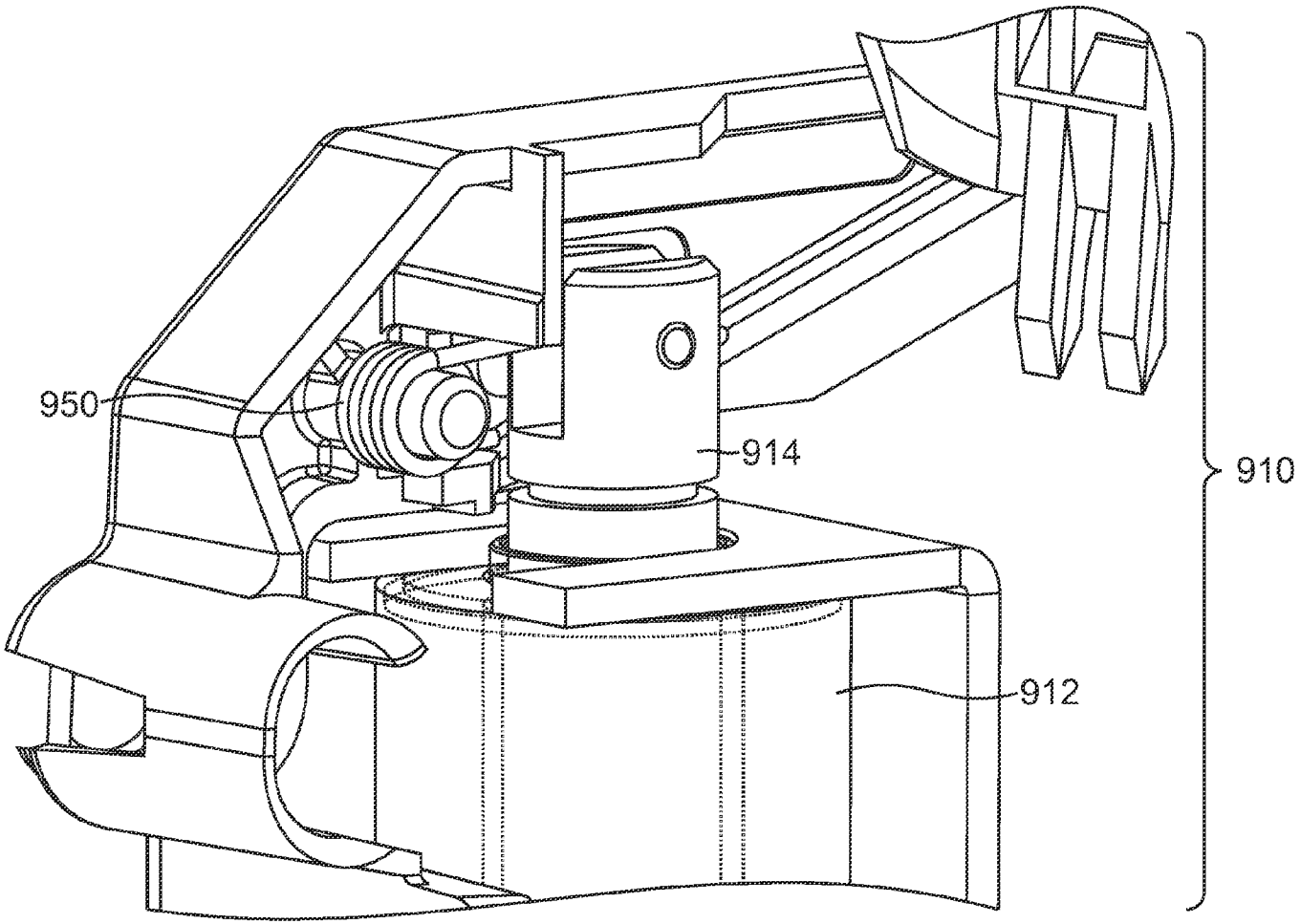
FIG. 12 is a schematic view of an actuator assembly according to an embodiment.

In this design, each actuator can be configured to control the displacement of each diverter member 100, 200, and 300 between a first position and a second position. In one embodiment, one or more of the actuators can comprise a solenoid (not shown) that is coupled to a diverter member 100, 200, or 300. As shown in FIG. 12, one or more of actuators 910 can be biased in a first or second position. For example, in the illustrated embodiment, a spring 950 is used to bias the actuator 910 in a default position. In this design, the actuator comprises a solenoid 912 that is coupled with a plunger 914 that is biased vertically by the spring 950.

While the actuator 910 is capable of providing binary position control of one or more diverter members 100, 200, and 300, it should be understood that in other aspects of the design, other types of actuators can be used to provide non-binary position control.

Figure 8A:
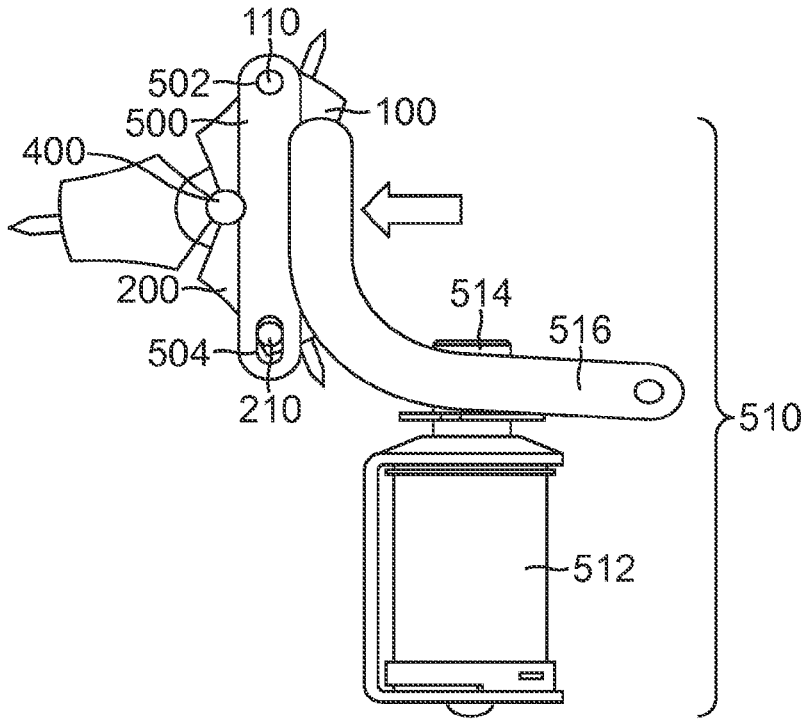
FIGS. 8*a* and 8*b* are schematic views of a triple-gate diverter in a first and second position according to an embodiment.
Figure 8B:
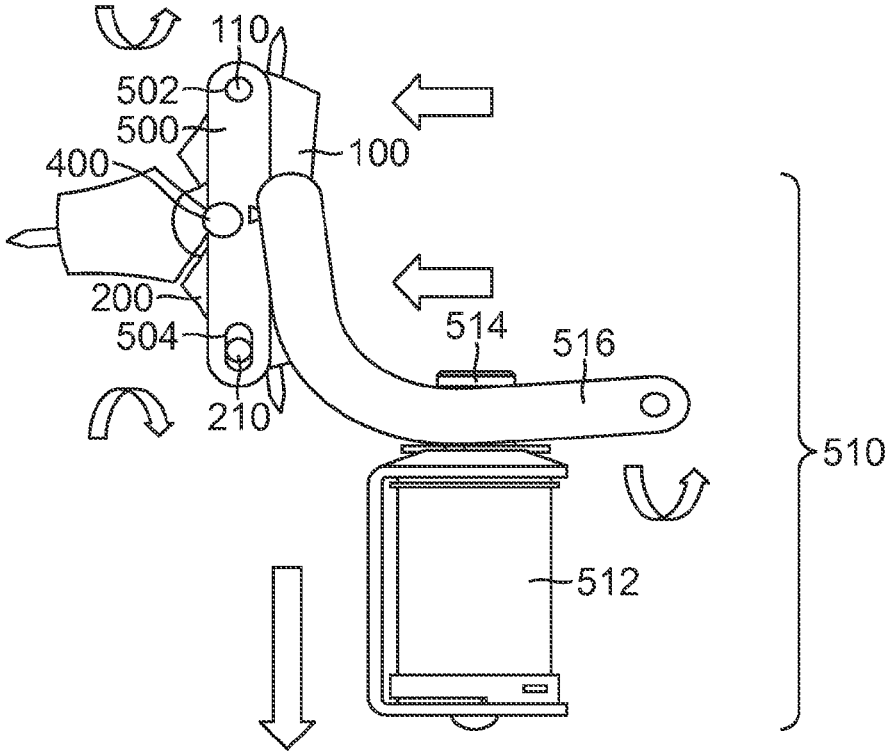

In one design, as shown in FIGS. 1, 5, 6 and 7, the triple-gate diverter can be configured to alternate between four positions, each defining a different combined bill path. These positions are established through rotation of at least one of the diverter members, which in turn may cause the rotation of one or more of the remaining diverter members. In one embodiment, as shown in FIGS. 8*a* and 8*b*, a coupler 500 is configured to connect to the linkage structures 110 and 210 of the first and second diverters 100 and 200, via slots 502 and 504, such that a rotation of the diverter member 100 in the clockwise (CW) direction causes rotation of diverter member 200 in the counterclockwise (CCW) direction and vice versa. In one aspect, the coupler 500 can comprise a slot 504, which itself is configured to limit the pivoting range of motion of the diverter members 100 and 200 about the shaft 400.

In this design, an actuator 510 comprises a solenoid 512, a plunger 514, and an extender 516. The solenoid 512 is coupled to the plunger 514 such that, depending on the state of the solenoid 512, the plunger can alternate between a first position, shown in FIG. 8*a*, and second position, shown in FIG. 8*b*. The plunger 514 is also coupled to the extender 516, which itself is coupled to the coupler 500. Thus, it should be clear that the actuator 510 cooperates with the coupler 500 to cause concerted pivoting of the diverter members 100 and 200 in opposite directions.

The operation of the gate system as shown in FIGS. 8*a* and 8*b* can be summarized for the first and second diverter members 100 and 200 as follows:

1. Each diverter member rotates about a common shaft
2. First and second diverter members 100 and 200 will be actuated at the same time
3. First and second diverter members 100 and 200 will have a Default (Home) Position (shown in FIG. 8*a*)
4. The first and second diverter members 100 and 200 are tied together with coupler 500 so that both diverter members rotate at the same time
5. The solenoid 512 is engaged, pulling its plunger 514 down. This causes the extender 516 that is connected to the plunger 514 to rotate CCW about its pivot
6. As the extender 516 rotates, it pushes the coupler 500 forward. Diverter member 100 will then rotate CCW and diverter member 200 will rotate CW
7. When the cycle is complete, the diverter members will return to Home Position via a torsional spring on the shaft.

For example, diverter member can 100 rotate 12 degrees CCW, while diverter member 200 rotates 12 degrees CW, at the same time.

While the coupler 500 cooperates with the actuator 410 to cause concerted pivoting of the diverter members 100 and 200 in opposite directions in this embodiment, it should be understood that the coupler 500, actuator 510, or any combination thereof can also be configured to cause concerted pivoting of the diverter members 100 and 200 in the same direction without departing from the spirit and scope of the disclosure. Regardless of the direction of movement, each of the diverters moves in concert with the others to define the desired bill path.

In a further aspect, the diverter member 300 is connected to an independent actuator (not shown), and is thus configured to alternate between the positions shown in FIGS. 1, 5, 6, and 7.

Figures 9A, 9B:
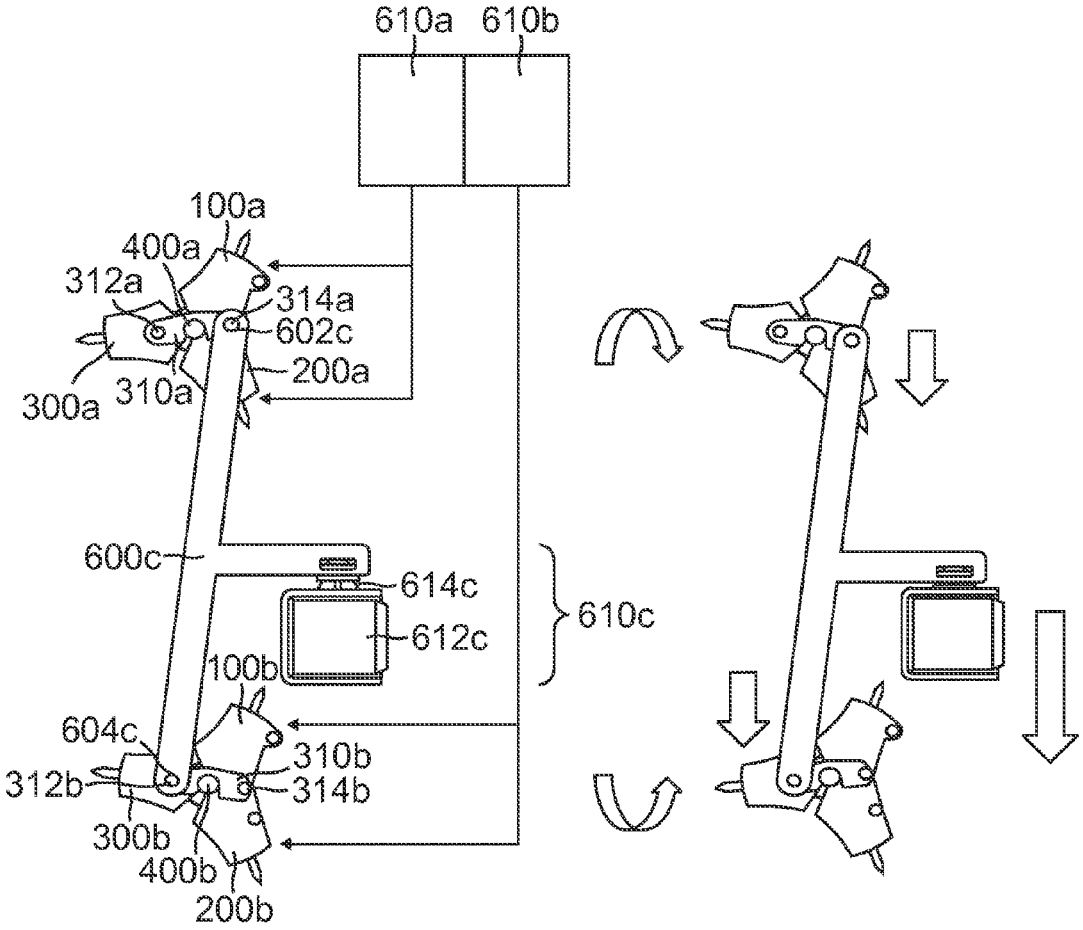
FIGS. 9*a* and 9*b* are schematic views of a dual-axis triple-gate diverter in a first and second position according to an embodiment.

In one embodiment, as shown in FIGS. 9*a* and 9*b*, a plurality of triple gate diverters can be combined to provide a multi-axis, triple-gate diverter system. For example, the system shown in FIGS. 9*a* and 9*b* employs two substantially identical triple diverters interconnect by a coupler operated by a solenoid, whereby the each diverter member works in concert with the other diverter members in a single triple diverter, and each triple diverter works in concert with the other to establish multiple bill paths, allowing for a wide variety of manipulations, with fewer actuators and/or solenoids.

In this design, an actuator 610*a* is configured to provide concerted positioning of the diverter members 100*a* and 200*a* between a first and second position. Similarly, an actuator 610*b* is coupled to diverter members 100*b* and 200*b* to provide concerted positioning of diverter members 100*b* and 200*b* between a first and second position.

In a further aspect, a coupler 600*c* is configured to connect to the linkage structures 310*a* and 310*b* of the diverter members 300*a* and 300*b*, such that a rotation of the diverter member 300*a* in the clockwise direction causes rotation of the diverter member 300*b* in the counterclockwise direction and vice versa. In this embodiment, each of the linkage structures 310*a* and 310*b* comprise a plurality of tabs 312*a*, 314*a*, 312*b*, and 314*b*, each of which is capable of cooperating with the coupler 600*c* slots 602*c* and 604*c* to provide a connection between the coupler 600*c* and the diverter members 300*a* and 300*b*.

In this embodiment, an actuator 610*c* comprises a solenoid 612*c*, and a plunger 614*c*, wherein the actuator 610*c* cooperates with the coupler 600*c* to cause concerted pivoting of the diverter members 300*a* and 300*b* in opposite directions about each respective shaft 400*a* and 400*b*.

The operation of the diverter members 300*a* and 300*b* can be summarized as follows:

1. The two diverter members 300*a* and 300*b*, for example 95 mm apart, will be linked together
2. The Default (Home) Position is shown in FIG. 9A
3. Coupler 600*c* will pull in the direction of the arrows shown in FIG. 9A on both diverters 300*a* and 300*b*, at the tabs 314*a* and 312*b* of linkage structures 310*a* and 310*b*
4. With the tabs 314*a* and 312*b* on opposite sides of the gate shafts 400*a* and 400*b*, the rotation of the two diverter members 300*a* and 300*b* will be in the opposite direction (one CCW and one CW)
5. When the cycle is complete, the diverter members 300*a* and 300*b* will return to Home Position.

6. Either a torsional spring attached to diverter member 300*b* or a return spring on the solenoid 612*c* will return the diverter members to the Home Position.

For example, diverter member 300*b* can rotate 13 degrees CCW, while diverter member 300*a* rotates 13 degrees CW, at the same time.

However, it should be understood that the coupler 600*c*, actuator 610*c*, or any combination thereof can also be configured to cause concerted pivoting of the diverter members 300*a* and 300*b* in the same direction without departing from the spirit and scope of the disclosure.

Figure 10A:
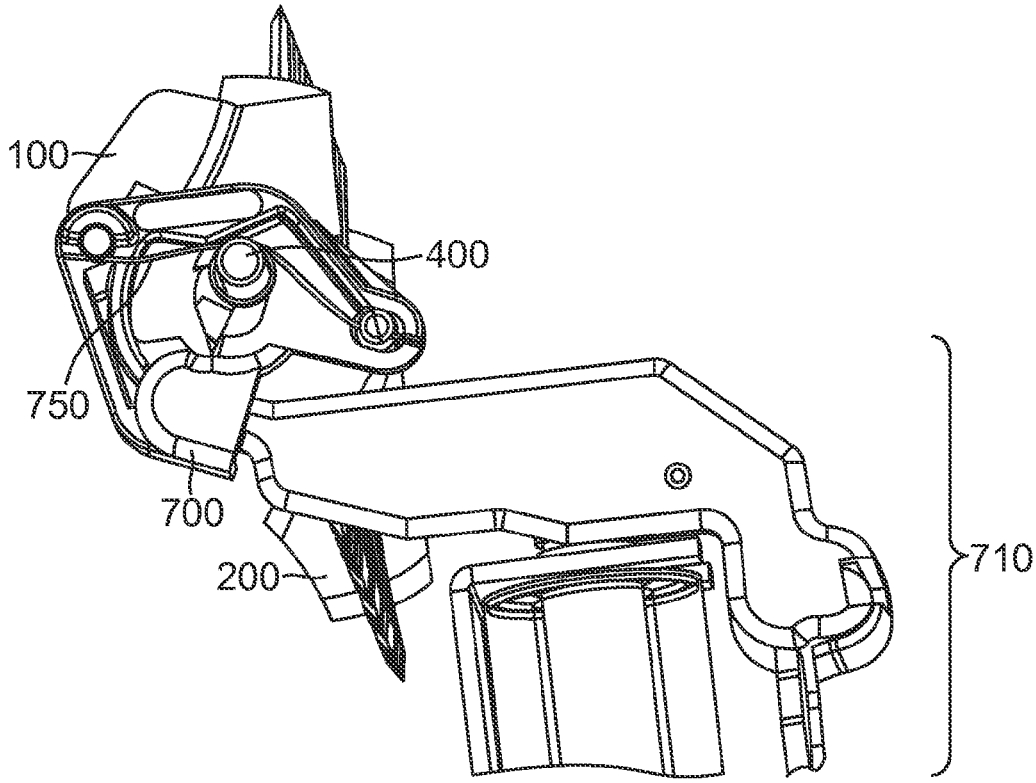
FIGS. 10*a* and 10*b* are schematic views of a triple-gate diverter in a first and second position according to an embodiment.
Figure 10B:
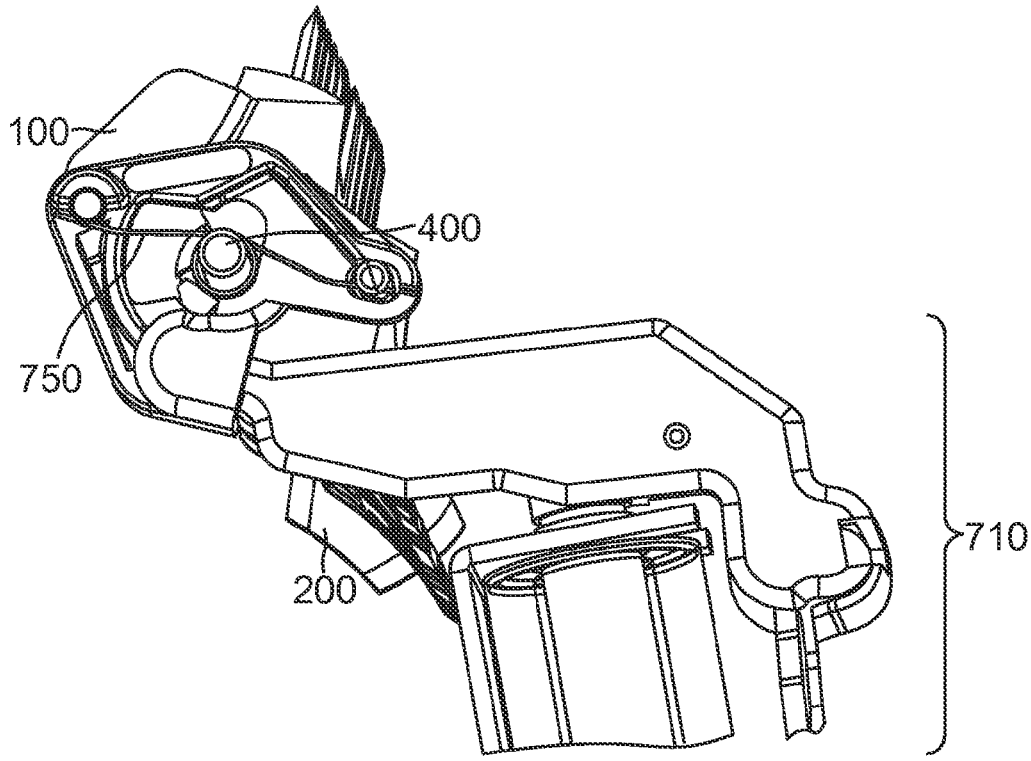

In another embodiment, some or all of the diverter members can be biased in a default position. For example, in one design, a spring 750 can be used to bias each of the diverter members 100 and 200 in a default position shown in FIG. 10*a*. In the illustrated state of the actuator 710, the spring cooperates with the coupler 700 to bias diverter member 100 in the counterclockwise direction, and diverter member 200 in the clockwise direction. A controller can be used to change the state of the actuator 710, causing the actuator 710 to cooperate with the coupler 700 to cause a concerted pivoting of the diverter members 100 and 200 to the position shown in FIG. 10*b*, and to overcome the tension in the spring 750.

Figure 11B:
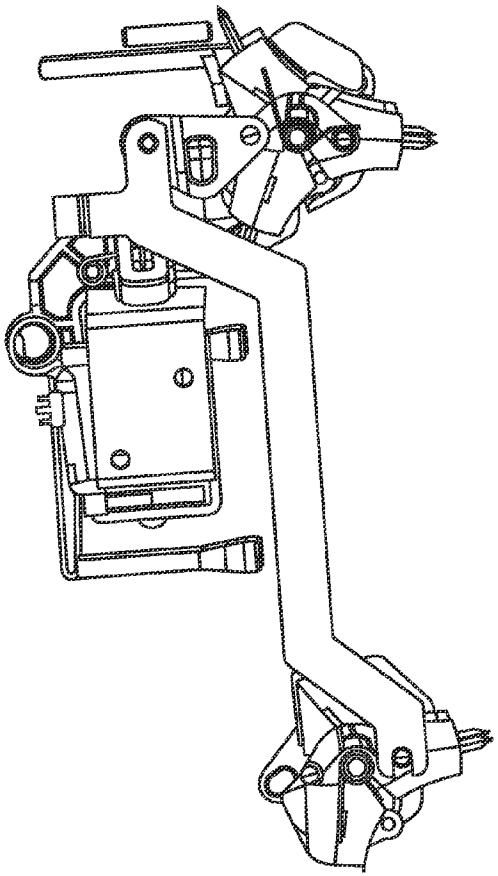
FIG. 11*a* and 11*b* are schematic views of a dual-axis triple-gate diverter in a first and second position according to an embodiment.
Figure 11A:
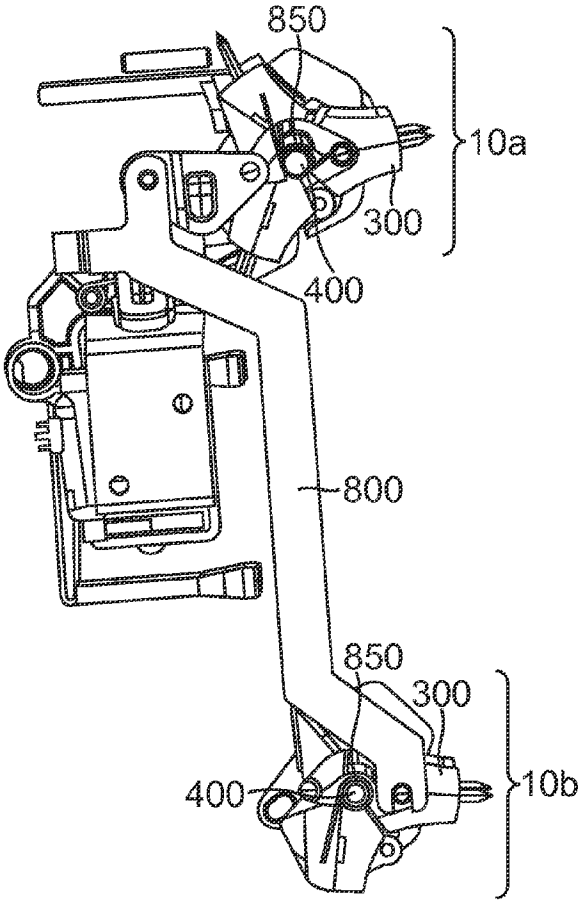

In a further aspect, as shown in FIG. 11*a*, each triple gate diverter assembly, 10*a* and 10*b*, comprises a diverter member 300, which is biased in a default position. As shown in FIG. 11*b*, each triple gate diverter assembly, 10*a* and 10*b*, an actuator can be used to cause a concerted pivoting of the diverter members 300 to the position shown in FIG. 11*b*, and to overcome the tension in each spring 850.

While the embodiments described in the preceding paragraphs describe the concerted biasing of diverter members, it should be understood that each diverter member is capable of being biased independently of the other diverter members. For example, in the absence of the coupler 800, each of the diverter members 300 would be biased in a default position independently of one another and independently of other diverter members in the triple gate diverter assembly 10*a* or 10*b*.

What is claimed is:

1. A diverter for use in a money handling device, the diverter comprising:

a longitudinal shaft defining a central longitudinal axis;

a first diverter member comprising:

a first outer longitudinal edge, a first inner longitudinal edge, mounted to said shaft for rotation about the central longitudinal axis, and a first bill handling surface between said first outer longitudinal edge and said first inner longitudinal edge;

a second diverter member comprising:

a second outer longitudinal edge, a second inner longitudinal edge, mounted to said shaft for rotation about the central longitudinal axis, and a second bill handling surface between said second outer longitudinal edge and said second inner longitudinal edge;

a third diverter member comprising:

a third outer longitudinal edge, a third inner longitudinal edge, mounted to said shaft for rotation about the central longitudinal axis, and a third bill handling surface between said third outer longitudinal edge and said third inner longitudinal edge; and a coupler connecting at least two of said first, second and third diverter members such that rotation of any one of said first, second and third diverter members connected to said coupler causes rotation of at least one of the other of the at least two of said first, second and third diverter members, thereby defining a combined bill path comprising two of the first bill handling surface, the second bill handling surface, and the third bill handling surface;

wherein the at least two of said first, second and third diverter members connected by the coupler pivot in opposite directions in response to an actuation of the coupler.

2. The diverter of claim 1 wherein any of the first, second, or third bill handling surfaces are configured to interleave with a bill path.

3. The diverter of claim 1 wherein a plurality of the first, second and third diverter members are configured to cooperate with each other to limit a diverter member range of rotation of at least one of said first, second and third diverter members.

4. The diverter of claim 1 further comprising an actuating member configured to actuate the coupler.

5. The diverter of claim 4 wherein the actuating member comprises a solenoid.

6. A diverter for use in a money handling device, the diverter comprising:

a longitudinal shaft defining a central longitudinal axis;

a first diverter member comprising:

a first outer longitudinal edge, a first inner longitudinal edge, mounted to said shaft for rotation about the central longitudinal axis, and a first bill handling surface between said first outer longitudinal edge and said first inner longitudinal edge;

a second diverter member comprising:

a second outer longitudinal edge, a second inner longitudinal edge, mounted to said shaft for rotation about the central longitudinal axis, and a second bill handling surface between said second outer longitudinal edge and said second inner longitudinal edge;

a third diverter member comprising:

a third outer longitudinal edge, a third inner longitudinal edge, mounted to said shaft for rotation about the central longitudinal axis, and a third bill handling surface between said third outer longitudinal edge and said third inner longitudinal edge; and a coupler connecting at least two of said first, second and third diverter members such that rotation of any one of said first, second and third diverter members connected to said coupler causes rotation of at least one of the other of the at least two of said first, second and third diverter members, thereby defining a combined bill path comprising two of the first bill handling surface, the second bill handling surface, and the third bill handling surface;

wherein the inner longitudinal edges of the first and second diverter members are configured to interengage.

7. The diverter of claim 6 wherein any of the first, second, or third bill handling surfaces are configured to interleave with the bill path.

8. The diverter of claim 6 wherein a plurality of the first, second and third diverter members are configured to cooperate with each other to limit a diverter member range of rotation of at least one of said first, second and third diverter members.

9. The diverter of claim 6 further comprising an actuating member configured to actuate the coupler.

10. The diverter of claim 9 wherein the actuating member comprises a solenoid.

11. A diverter system for use in a money handling device, the diverter comprising:

a first triple diverter comprising:

a longitudinal shaft defining a central longitudinal axis, a first diverter member comprising:

a first outer longitudinal edge, a first inner longitudinal edge, mounted to said shaft for rotation about the central longitudinal axis, and a first bill handling surface between said first outer longitudinal edge and said first inner longitudinal edge, a second diverter member comprising:

a second outer longitudinal edge, a second inner longitudinal edge, mounted to said shaft for rotation about the central longitudinal axis, and a second bill handling surface between said second outer longitudinal edge and said second inner longitudinal edge, a third diverter member comprising:

a third outer longitudinal edge, a third inner longitudinal edge, mounted to said shaft for rotation about the central longitudinal axis, and a third bill handling surface between said third outer longitudinal edge and said third inner longitudinal edge, and a coupler connecting the first and second diverter members such that rotation of any one of the first and second diverter members causes rotation of at least one of the other two of the first, second and third diverter members, thereby defining a combined bill path consisting of two of the first bill handling surface, the second bill handling surface, and the third bill handling surface;

a second triple diverter comprising:

another longitudinal shaft defining a central longitudinal axis, a first diverter member of the second triple diverter comprising:

a first outer longitudinal edge, a first inner longitudinal edge, mounted to said shaft for rotation about the central longitudinal axis, and a first bill handling surface between said first outer longitudinal edge and said first inner longitudinal edge, a second diverter member of the second triple diverter comprising:

a second outer longitudinal edge, a second inner longitudinal edge, mounted to said shaft for rotation about the central longitudinal axis, and a second bill handling surface between said second outer longitudinal edge and said second inner longitudinal edge, a third diverter member of the second triple diverter comprising:

a third outer longitudinal edge, a third inner longitudinal edge, mounted to said shaft for rotation about the central longitudinal axis, and a third bill handling surface between said third outer longitudinal edge and said third inner longitudinal edge, and a coupler connecting the first and second diverter members of the second triple diverter such that rotation of any one of the first and second diverter members of the second triple diverter causes rotation of at least one of the other two of the first, second and third diverter members of the second triple diverter, thereby defining a combined bill path comprising two of the first bill handling surface of the second triple diverter, the second bill handling surface of the second triple diverter, and the third bill handling surface of the second triple diverter; and a coupling arm connecting the first triple diverter and second triple diverter such that rotation of any one of the first, second and third diverter members of the first triple diverter causes complementary rotation in the second triple diverter.

12. The diverter system of claim 11, wherein the coupling arm is connected to a solenoid for facilitate movement of the coupling arm.

13. The diverter system of claim 11, wherein the coupling arm couples the third diverter member of the first triple diverter and the third diverter member of the second triple diverter.

* * * * *